US005116150A

United States Patent [19]

Courtney

[11] Patent Number: 5,116,150

[45] Date of Patent: May 26, 1992

[54] APPARATUS AND METHOD FOR MAPPING AND ALIGNING DIGITAL IMAGES ONTO PRINTED MEDIA

[75] Inventor: Thomas P. Courtney, Santa Clara, Calif.

[73] Assignee: Apple Computer, Inc., Cupertino, Calif.

[21] Appl. No.: 639,585

[22] Filed: Jan. 9, 1991

[51] Int. Cl.[5] ..... A41J 25/28

[52] U.S. Cl. ..... 400/320; 400/322; 400/323

[58] Field of Search ..... 400/124, 708, 342, 279, 400/320, 322, 323, 320.1, 63

[56] References Cited

U.S. PATENT DOCUMENTS

| | | | |
|---|---|---|---|
| 4,149,619 | 4/1979 | Kashio | 400/279 |
| 4,179,223 | 12/1979 | Kwan et al. | 400/320 |
| 4,272,204 | 6/1981 | Quinn, Jr. et al. | 400/342 |
| 4,311,399 | 1/1982 | Wegryn et al. | 400/124 |
| 4,459,675 | 7/1984 | Bateson et al. | 400/322 |
| 4,493,570 | 1/1985 | Araul | 400/322 |
| 4,618,275 | 10/1986 | Brinuman et al. | 400/63 |
| 4,688,956 | 8/1987 | Miyake | 400/320 |
| 4,781,478 | 11/1988 | Eguchi | 400/279 |
| 4,804,284 | 2/1989 | Hattori et al. | 400/279 |
| 4,806,034 | 2/1989 | Plummer | 400/279 |
| 4,832,518 | 5/1989 | Moriyama | 400/322 |
| 4,844,635 | 7/1989 | Malkemes et al. | 400/124 |
| 5,007,751 | 4/1991 | Yamakawa | 400/322 |

FOREIGN PATENT DOCUMENTS

| | | | |
|---|---|---|---|
| 57-4789 | 1/1982 | Japan | 400/705.1 |
| 59-190882 | 10/1984 | Japan | 400/708 |
| 61-270179 | 11/1986 | Japan | 400/708 |
| 62-256679 | 11/1987 | Japan | 400/708 |
| 63-112177 | 5/1988 | Japan | 400/708 |
| 63-412178 | 5/1988 | Japan | 400/708 |

*Primary Examiner*—Eugene H. Eickholt

*Attorney, Agent, or Firm*—Blakely, Sokoloff, Taylor & Zafman

[57] ABSTRACT

The subject invention is an optical sensor detection system for a serial printer useful for the determination of alignment and misalignment of images on a sheet of print media and the correction of misalignment. The present invention includes a photoelectric sensor mounted on the carriage of a serial type printer to locate various indicator markings.

In operation the sensor detects the position of a mid-point indicator when the carriage travels from right to left, and then from left to right. The positional information is then compared with the assumed mid-carriage position of the print head based upon the time of travel, that is, the predicted position of the sensor assuming no flex in the support members of the print head and no stretch of the belt driving the print head. The difference between the actual position and the assumed position is then used to derive a correction factor to the right to left and left to right printing parameters, and is used to compensate the timing of the placement of dots on the print media so that they are aligned in each pass.

2 Claims, 3 Drawing Sheets

FIG_3
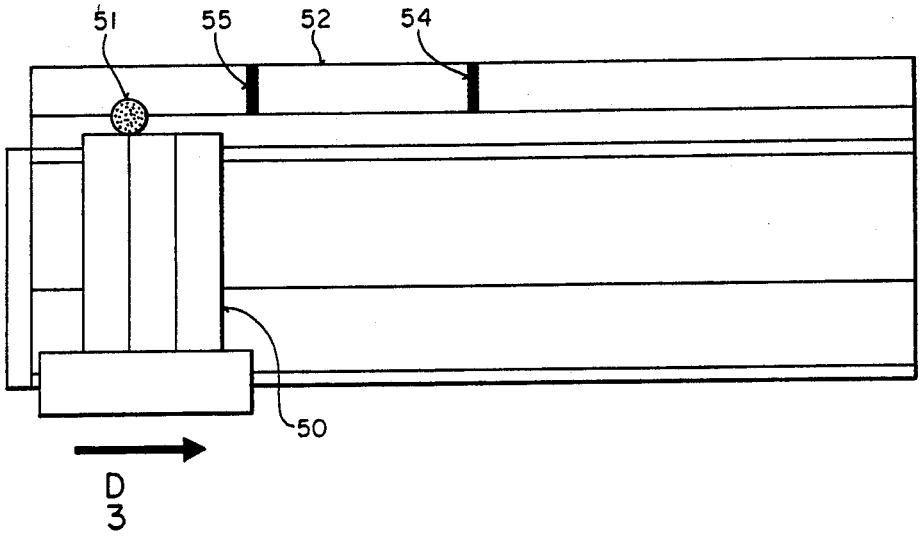
FIG_4
PTO
FIG_5
PTO
FIG_6
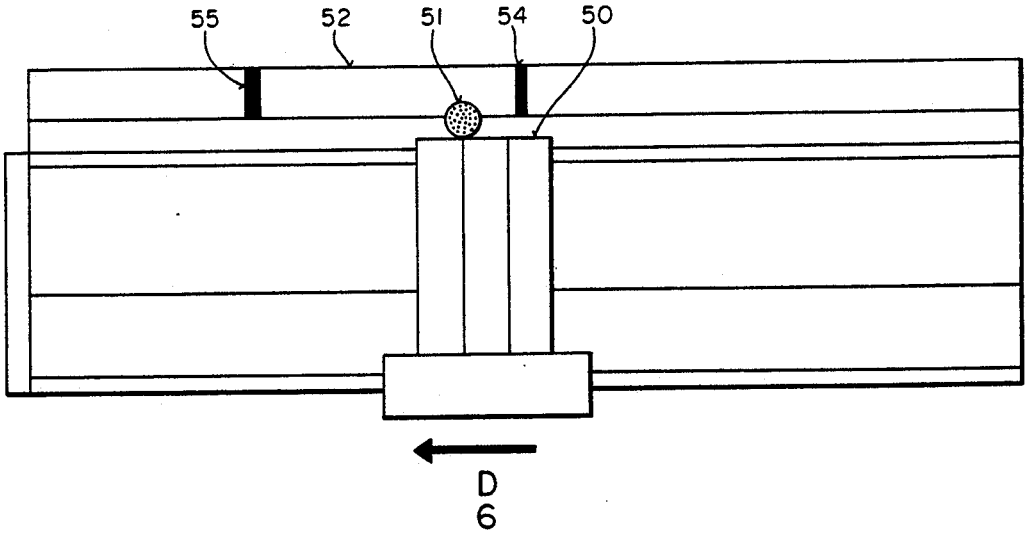

APPARATUS AND METHOD FOR MAPPING AND ALIGNING DIGITAL IMAGES ONTO PRINTED MEDIA

BACKGROUND OF THE INVENTION

1. Field of the Invention

The present invention relates to printer systems, and more particularly, to an improved printer system having an optical sensor device for detecting positioning and alignment of print media and determining correct printing position and alignment thereon.

2. Art Background

Many ink jet printers print while moving in both directions, that is, left to right and then right to left across the paper or other print media. It is thus important for the printer to be able to line up text and graphics on a page so that it is printed in the desired position on the paper independent of the direction of movement of the print head. Presently, when an ink jet print head is calibrated to make such proper alignment, a trained technician monitors the movement of the print head backward and forward across the print media, and then manually adjusts the print head moving means to compensate for any inaccuracies. Several inaccuracies are taken into account in this process, including system backlash from the gearing in the stepper motor system which drives the print head, the stretching of the belt of the print head drive system, and mechanical stress of the support members which support the belts and pulleys of the drive system.

Generally prior to shipment, or immediately upon installation, a technician calibrates the ink jet printer by detecting what the printer believes is the center of a line in both forward and backward movement of the print head, and then by manipulation of a plurality of dip switches which control the movement of the print head and adjust the movement of the print head so that the center position of the print head is properly aligned for both forward and backward movement thereof.

It has also been found that, particularly with respect to ink jet printers, that as the printer wears, there is increased flexure of the support members which support the print head and increased stretching of the belt which moves the print head. As a result, the printer head believes it is in a particular position, but in fact, it is displaced by the amount of flexure in the support members. The effect of this error is shown diagrammatically in FIGS. *2a* and *2b*. In FIG. *2a* it is shown that the support members and belts are relatively rigid, and therefore, after initial calibration, the alignment of the print in both directions is correct. In FIG. *2b*, it is shown that the increased stretch and flexure of the system causes the print to misalign.

Thus, there are several drawbacks to this type of system. First, the dip switches are required, which adds cost and complexity to the manufacture of the printer. Second, the manual calibration of the printer requires time and the input of a skilled technician, the accuracy of which is dependent upon the skill of the technician. Third, as the printer ages over time, the stretch of the drive belt and the flexure of the mechanical support members changes, and in particular, the stretch and flexure increases. As a result, the alignment of the print from the print head travelling in opposite directions changes, causing misalignment and less than desirable image quality. Consequently it is necessary to recalibrate the printer over time as the calibration drifts.

There are two general types of drive head movement control systems which are presently employed. The first is a timing based control system which measures the time a print head is moving in a particular direction, and then, knowing the speed of the print head and the beginning point of the movement from either side of the page, the system determines the location of the print head. The second type of print head movement control system relies upon a magnetically encoded or optical position detection means which indicates the position of the print head relative to the print carriage.

Prior art serial type printers presently have incorporated therein a photoelectric sensor disposed on the print head to detect the home position of the carriage. However, such photoelectric sensors are not currently used in this type of printer to detect any information relative to the positioning and alignment of paper or other print media disposed in the printer. Thus the present invention seeks to overcome this and other disadvantages of the prior art serial printer systems.

SUMMARY OF THE INVENTION

The present invention is an optical sensor detection system for a serial printer useful for the determination of alignment and misalignment of images on a sheet of print media and the correction of misalignment. The present invention comprises a photoelectric sensor mounted on the carriage of a serial type printer to locate various indicator markings and other critical markings. The sensor is disposed adjacent the platen. In addition, the sensor may be designed to detect the home marking and may be used to detect the edges of the paper as well for other purposes described in my co-pending application.

The sensor determines the alignment or misalignment of the print head in the middle of the carriage while the print head is traveling at its typical print velocity. The misalignment reflects degradation of the system, such as stretched belts and increased flexure of the support members. The system also corrects for any misalignment errors.

In operation the sensor detects the position of a midpoint indicator when the carriage travels from right to left, and then from left to right. The positional information is then compared with the assumed mid-carriage position of the print head based upon the time of travel or encoded position indicators as discussed above, that is, the predicted position of the sensor assuming no flex in the support members of the print head and no stretch of the belt driving the print head. The difference between the actual position and the assumed position is then used to derive a correction factor to the right to left and left to right printing parameters, and is used to compensate the timing of the placement of dots on the print media so that they are aligned in each pass.

It is an object of the present invention to utilize a photosensor for a variety of purposes for printing clear and accurate high quality pictures and text.

It is another object of the present invention to provide a printer control system which self-corrects inaccuracies and other alignment problems associated with a serial type ink jet printer.

It is yet another object of the present invention to provide a printer control system which adjusts the alignment of the printer in forward and backward printing movements.

It is yet another object of the present invention to provide an alignment and calibration system for a serial type printer so that there is no longer an absolute need for dip switches for calibration of the printer head positioning.

The advantages of the method and apparatus of the present invention will be understood with reference to the drawings described briefly below and the detailed description thereof following thereafter.

The advantages of the method and apparatus of the present invention will be understood with reference to the drawings described briefly below and the detailed description thereof following thereafter.

BRIEF DESCRIPTION OF THE DRAWINGS

FIG. 2*a* illustrates a typical support and drive system for a print head. FIG. 2*b* illustrates the same system affected by belt stretching and support member flexure.

FIG. 3 is a top plan view of the present invention with the carriage adjacent the left end.

FIG. 4 is an illustration of a printed word wherein the bidirectional printing is misaligned.

FIG. 5 is an illustration of a printed word wherein the bidirectional printing is aligned.

FIG. 6 is a top plan view of the present invention with the carriage near the mid-carriage indicia marker.

DETAILED DESCRIPTION OF THE INVENTION

The present invention comprises a serial printer system for the detection of alignment of a printer carriage, correction of alignment of the printer carriage, and related functions which may be achieved by the used of the subject invention. The present invention comprises the apparatus and method for achieving the foregoing functions in accordance with the detailed description thereof presented herein.

Figure 1:
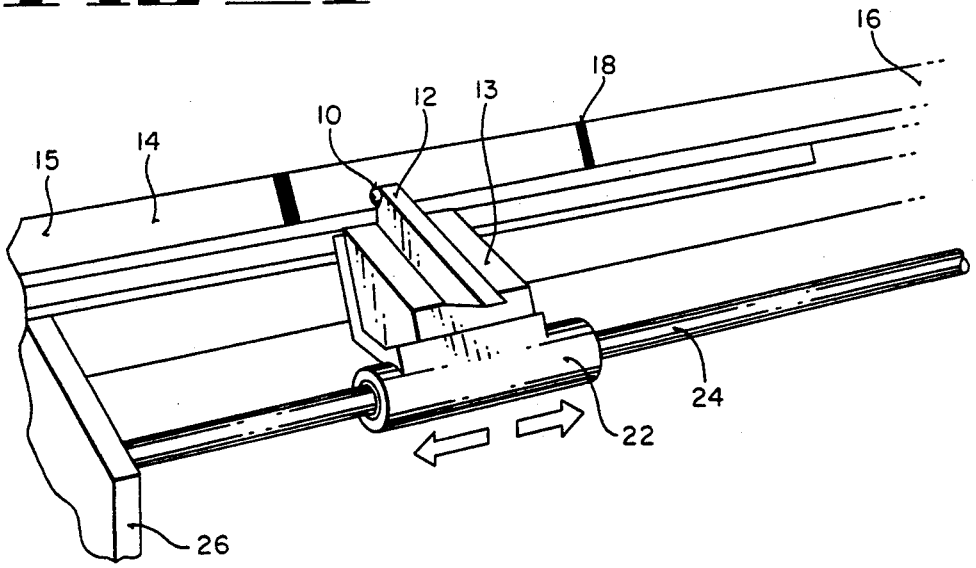
FIG. 1 is a perspective view of the printer system of the present invention.

FIGS. 4 and 5 depict the problem which the present invention is designed to alleviate. In FIG. 4, the letters PTO which are representative of the printing from a serial type printer which makes a bidirectional pass to print the entire letters, are misaligned, with the upper portion of the letters printing further to the right than the lower part of the letters. This problem may be due to the excessive deflection of the supports members and stretch of the print head drive members as explained herein, which causes the print head to print further over to the right. The present invention comprises a photosensor disposed on a printer head for the detection of light reflected off of a platen or a piece of paper depending upon the particular function or operation to be achieved. As shown in FIG. 1, the invention comprises an optical sensor 10 disposed in a sensor housing 12 disposed on the printer head 13 and positioned adjacent the platen 14. The platen 14 has a left end 15 and a right end 16, and at least one mid-line indicia marker 18. A second home position indicia marker 20 may also be provided. The printer head 13 is mounted on a carriage 22. In operation, the printer head 23 moves side to side as depicted by the arrows D1, along bar 24. The bar 24 is retained by support members 26.

The photosensor 10 as used in the present invention is a standard infrared sensor as is available from Sharp Photoelectronics, or many other commercial suppliers, and is typically used in photocopiers and printers to determine if paper is present in a particular location. The photosensor is designed to provide a signal indicating light, such as paper, or light areas of a platen, and dark, such as dark areas of a platen. The photosensor in combination with the printer system can also detect small areas of color transition, such as hash marks on a light background.

Figure 2A:
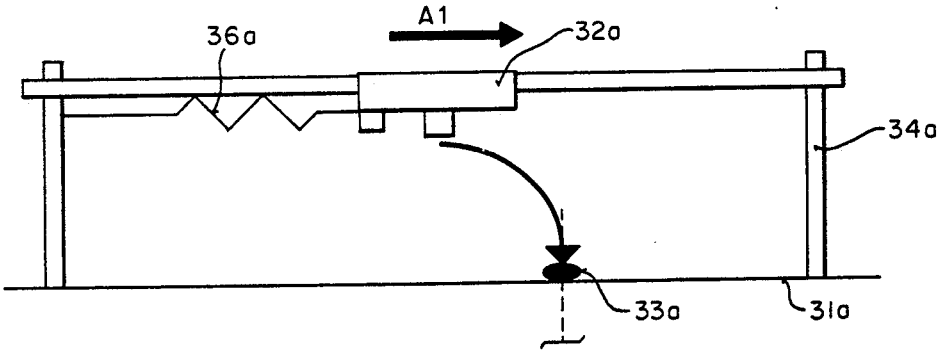
FIG 2A (PRIOR ART)
FIGS. 2*a* and 2*b* are schematic drawings which illustrate the problems in the prior art associated with belt stretching and support member flexure in accordance with the present invention.
Figure 2B:
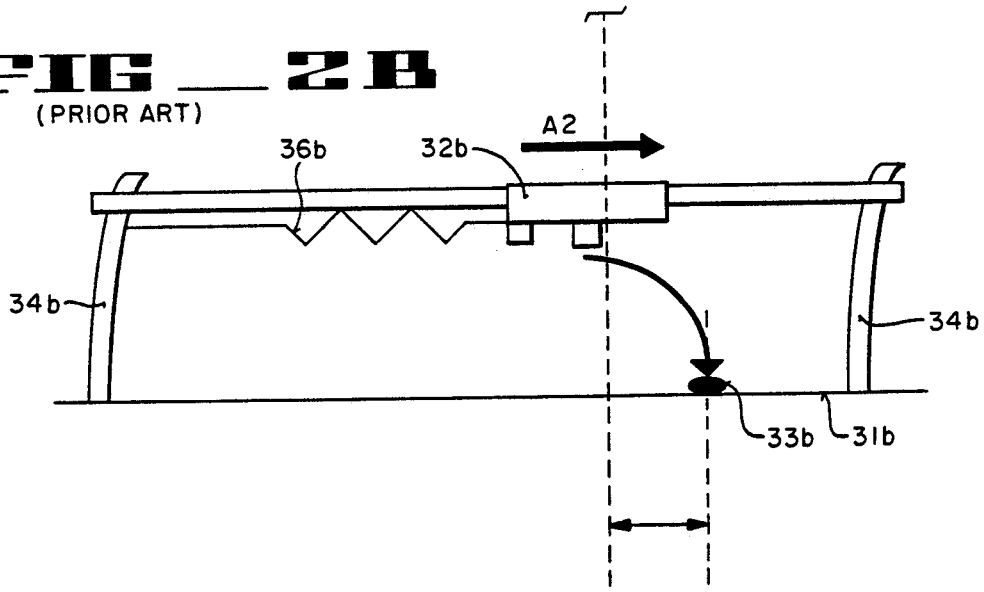
FIG 2B (PRIOR ART)

FIGS. 2*a* and 2*b* illustrate in schematic form the effects of printer component extension and flexing as a result of wear and aging of the printer. As shown in FIG. 2*a*, the printer, which is not worn, with printer head 32*a* moving in the direction depicted by arrow A1 projects an ink drop 33*a* at the proper location on media 31*a* as indicated by an arrow. It should be noted that there is no flexure of the support means 34*a* and no excessive extension of the printer head drive means 36*a*. As shown in FIG. 2*b*, the support means 34*b* are flexed, and the drive means 36*b* is excessively stretched, so that the drop 33*b* misses its mark as indicated by the arrow. The ghost lines illustrate the mis-alignment due to the flexion and extension of the printer components in FIG. 2*b* as compared with FIG. 2*a*.

FIG. 3 shows a stage in the operation of the subject invention in which the carriage 50 is disposed on the left side of the printer, prior to it traveling in direction D3 towards the right side. Upon startup of the printer, or upon calibration request, the printer carriage moves from left to right, scans the platen 52 passing the home position marker 55 and then the mid-carriage position marker 54. The home position marker is not necessary for this invention. It is necessary for the invention described in my copending application entitled "Device and method of registering image relative to border of printed media" Ser. No. 07/639,827, filed Jan. 9, 1991, and will not be discussed further herein.

Figure 7:
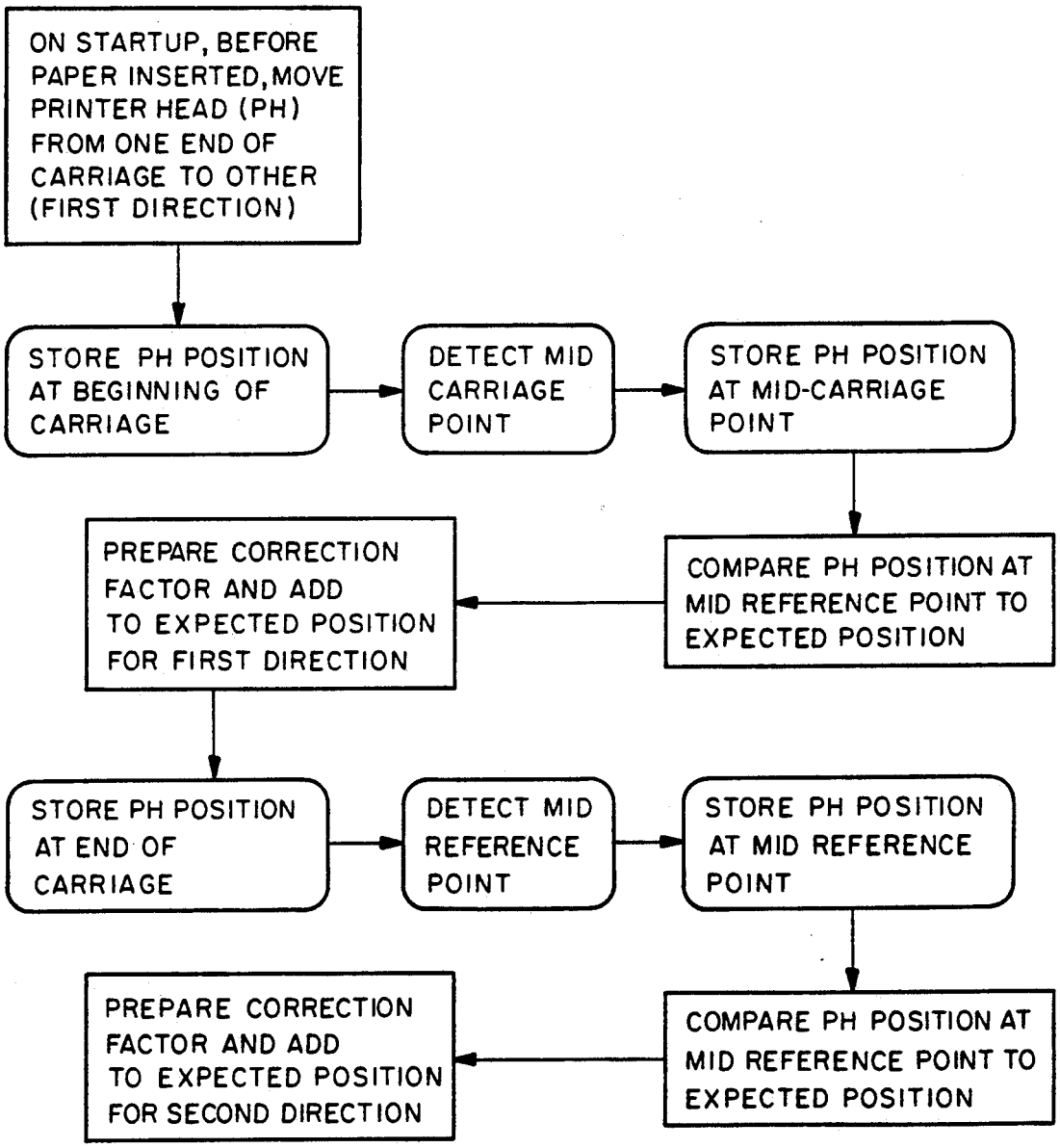
FIG. 7 is a flow chart illustration of one embodiment of the present invention.

The sensor 51, when it passes each of the respective markers, identifies the position information, which usually is clock timing information and stores that information in a register. The system has recorded the preset anticipated clock time for the carriage to reach the mid-carriage position marker which is installed system wide and then adjusted during initial calibration of the system. The system compares the anticipated clock time with the actual clock time and calculates the difference if any between the two. This difference is then added or subtracted from the actual clock time print instructions of the printer during the printing by adding in a delay or accelerating the print for the entire line. The steps of the present invention are set forth in the flow chart of FIG. 7.

Because printing is bidirectional, the same function is provided in the right to left movement of the carriage depicted as D6 as shown in FIG. 6. The sensor 51 notes the clock time of the mid-carriage position marker 54 and compares it to the anticipated clock time, and then corrects the print instructions for the right to left print function.

It will be obvious to a person of ordinary skill in the art that many changes and modifications can be made to the above-described systems which will fall within the spirit and scope of the invention as set forth in the appended claims.

What is claimed is:

1. A printer system having a print head, a platen having first and second ends, a means including a carriage for moving said print head relative to said platen and a timer based print means, said printer system comprising:

an indicator means disposed on said platen;

a light sensor means associated with said print head for detecting said indicator means disposed on said platen;

an actual mid-carriage marker means;

a predetermined mid-carriage indicator means associated with said timer based print means for indicating to said print system the perceived mid-carriage position;

means for comparing the position of said mid-carriage marker means with the position of said predetermined mid-carriage means;

means for calculating a timing correction based upon said comparing means to correct the timing of said printing means for each direction of travel of said print head, and means for correcting the print timing of said print head for each direction of travel of said print head based upon said means for calculating said timing correction.

2. A method of determining and correcting the alignment of a print head of a serial printer which utilizes bidirectional printing, comprising the steps of:

providing a printer system comprising said print head, means including a carriage for moving said print head bidirectionally, timing means for determining the activation and deactivation of said print head, sensor means for detecting a midcarriage indicia marker, a platen having first and second ends and said mid-carriage indicia marker, and a perceived mid-carriage indicator associated with said timing means;

moving said print head to a first end of said platen;

moving said print head toward said second end of said platen and monitoring said sensor means for detection of said mid-carriage indicia marker;

comparing the position of said perceived mid-carriage indicator with said mid-carriage indicia marker and determining the difference therebetween;

correcting the timing means of said print system to align said perceived mid-carriage indicator with said mid-carriage indicia marker;

moving said print head to a second end of said platen;

moving said print head toward said first end of said platen and monitoring said sensor means for detection of said mid-carriage indicia marker;

comparing the position of said perceived mid-carriage indicator with said mid-carriage indicia marker and determining the difference therebetween; and correcting the timing means of said print system to align said perceived mid-carriage indicator with said mid-carriage indicia marker.

* * * * *